United States Patent [19]

Henriques

[11] 4,416,771

[45] Nov. 22, 1983

[54] MINE ORE CONCENTRATOR

[76] Inventor: Lance L. Henriques, 15 Claremont Ave., New York, N.Y. 10027

[21] Appl. No.: 256,688

[22] Filed: May 23, 1981

[51] Int. Cl.[3] ..... B03C 1/14

[52] U.S. Cl. ..... 209/224; 209/232; 209/39; 209/227; 335/297

[58] Field of Search ..... 207/212, 459, 434, 470, 207/214; 209/224, 232, 223 A, 223 R, 39, 227

[56] References Cited

U.S. PATENT DOCUMENTS

| | | | |
|---|---|---|---|
| 731,041 | 6/1903 | Gates | 209/212 |
| 954,015 | 4/1910 | Bent | 209/232 |
| 1,024,045 | 4/1912 | Weatherby, Jr. et al. | 209/224 |
| 1,605,117 | 11/1926 | Koizumi | 209/223 R |
| 2,012,997 | 10/1952 | Harvengt | 209/490 X |
| 2,048,316 | 7/1936 | Beatty | 209/212 X |
| 2,072,907 | 3/1937 | Rowand | 209/232 |
| 2,398,725 | 4/1946 | Schutte | 209/232 |
| 2,402,441 | 6/1946 | Paddle | 209/224 |
| 2,431,559 | 11/1947 | Humphreys | 209/459 X |
| 2,658,452 | 11/1953 | Donelian | 209/227 |
| 2,925,177 | 2/1960 | Troland | 209/490 X |
| 2,974,799 | 3/1961 | Gray | 209/434 |
| 3,197,402 | 7/1965 | Ruskin | 209/212 X |
| 3,399,134 | 8/1968 | Schouw et al. | 209/232 |
| 3,552,564 | 1/1971 | Burgener | 209/214 |
| 3,608,718 | 9/1971 | Aubrey, Jr. et al. | 209/223 R |
| 3,825,516 | 7/1974 | Benowitz | 209/212 |
| 3,984,309 | 10/1976 | Allen et al. | 209/223 R |
| 4,069,145 | 1/1978 | Sommer, Jr. et al. | 209/212 |
| 4,085,039 | 4/1978 | Allen | 209/227 |
| 4,187,170 | 2/1980 | Westcott | 209/214 |
| 4,238,323 | 12/1980 | Zakharova | 209/212 |

FOREIGN PATENT DOCUMENTS

| | | | |
|---|---|---|---|
| 298617 | 4/1930 | Fed. Rep. of Germany | 209/227 |
| 2317957 | of 0000 | France | 209/214 |
| 17588 | 10/1980 | France | 209/212 |
| 20552 | of 1914 | United Kingdom | 209/232 |
| 649465 | 2/1977 | U.S.S.R. | 209/214 |

*Primary Examiner*—Tim R. Miles

[57] ABSTRACT

An eddy current magnetic ore concentrator, using parallel cup cores, where an alternating and direct independent field with phase offset removes and sorts metallic ore components from ferrous and nonferrous ore, where the metal may be in solution or the native form.

7 Claims, 11 Drawing Figures

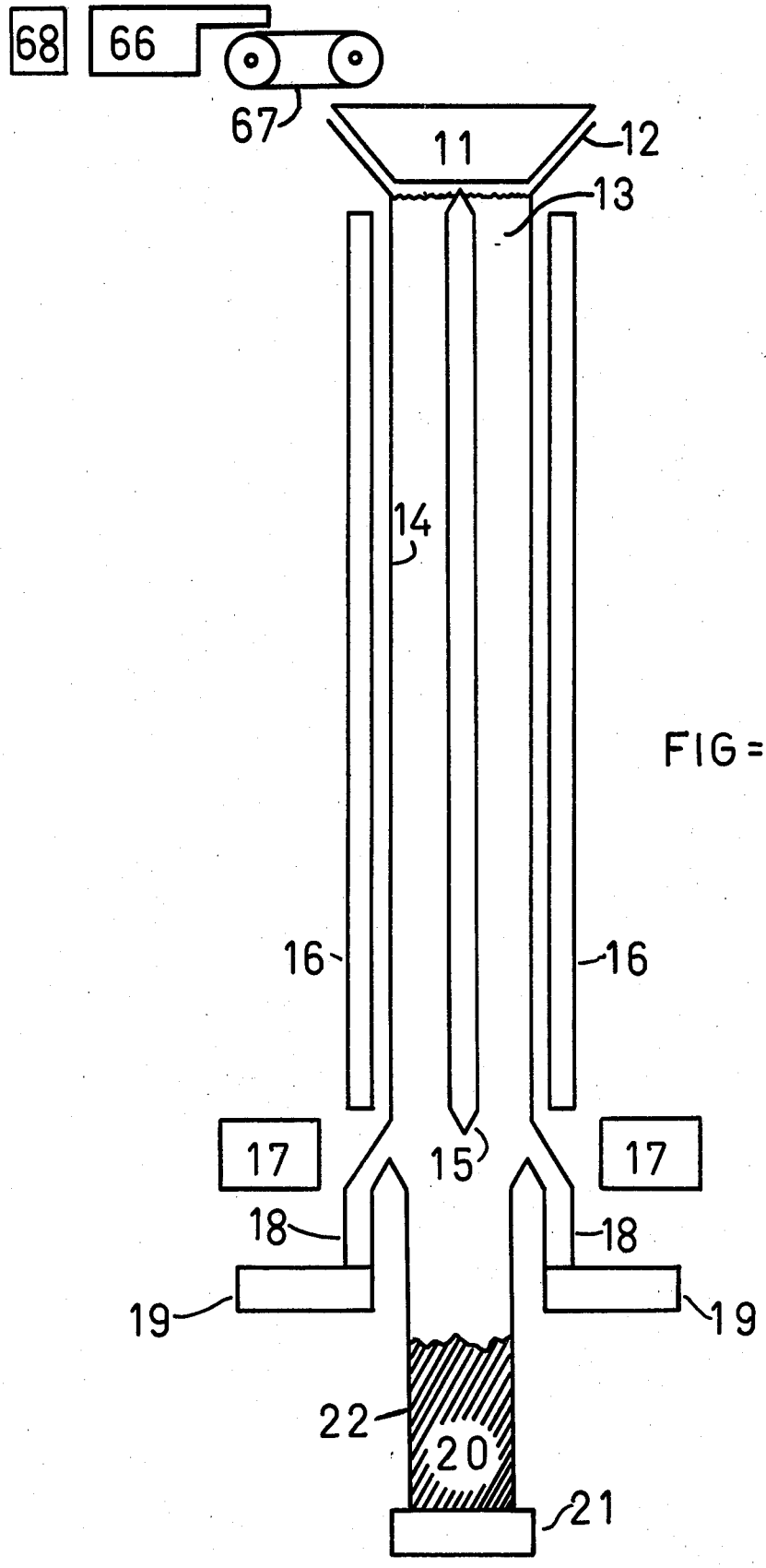
FIG = 1

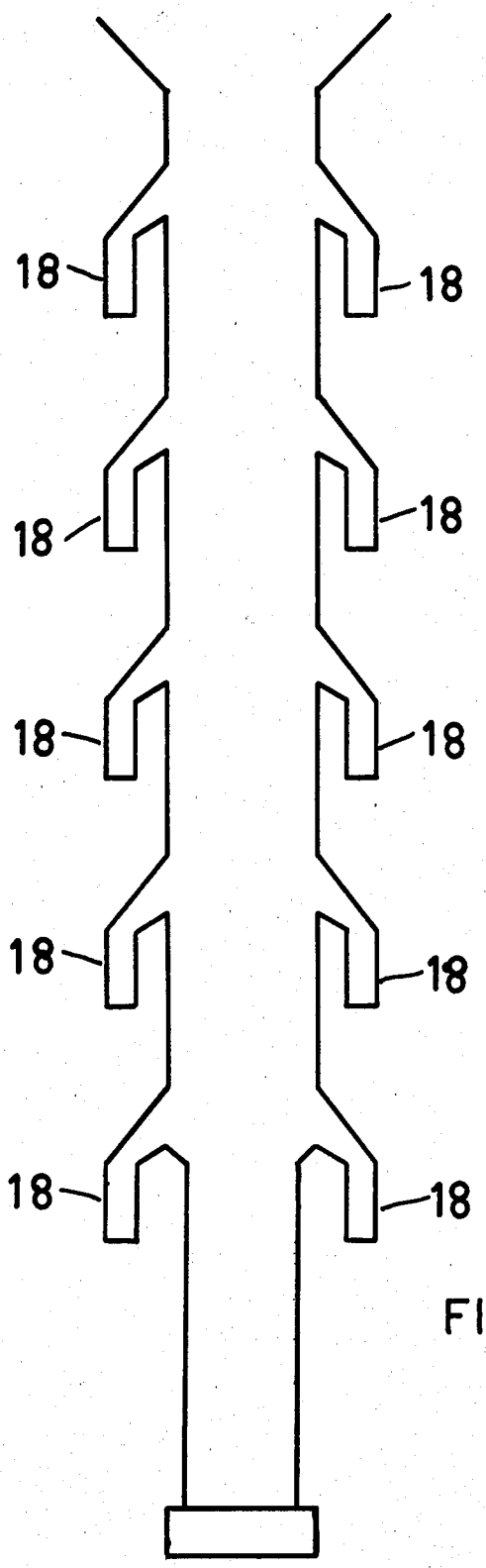
FIG=2

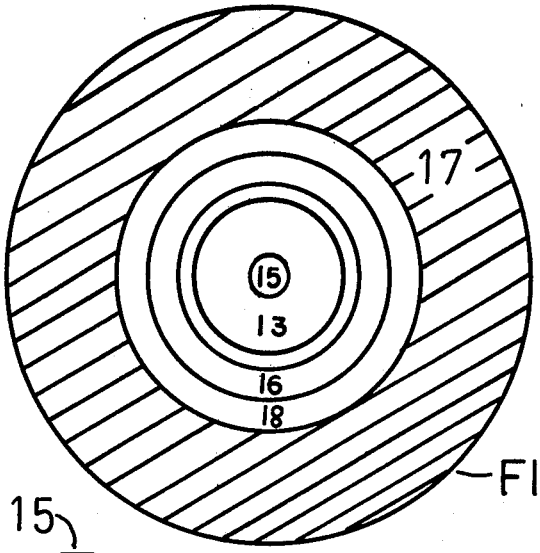
FIG 8
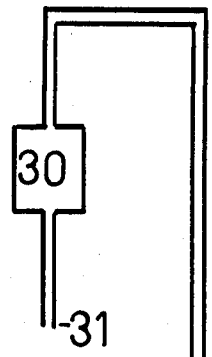
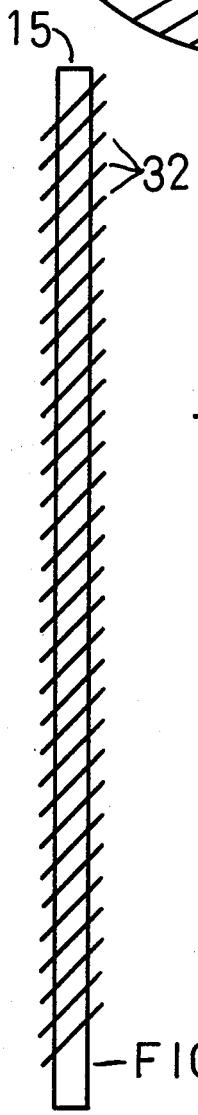
FIG=4
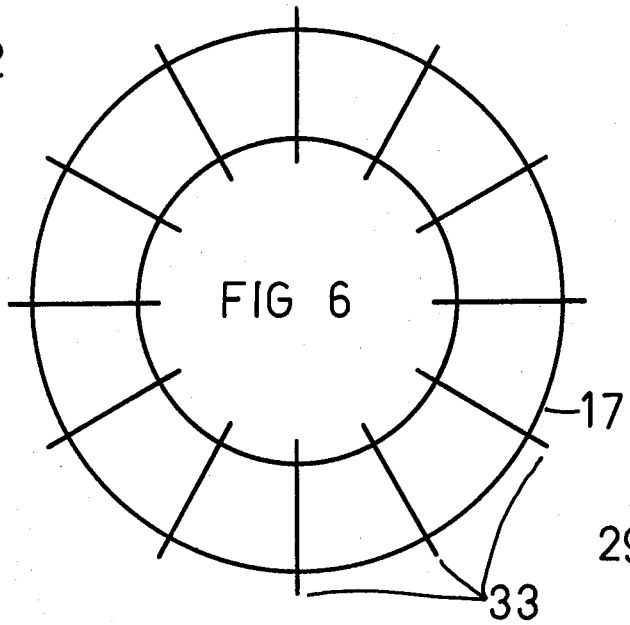
FIG 6
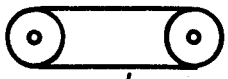
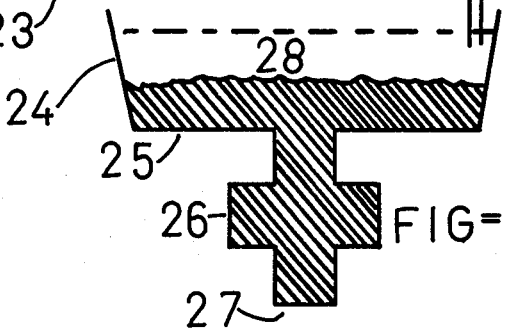
FIG=3

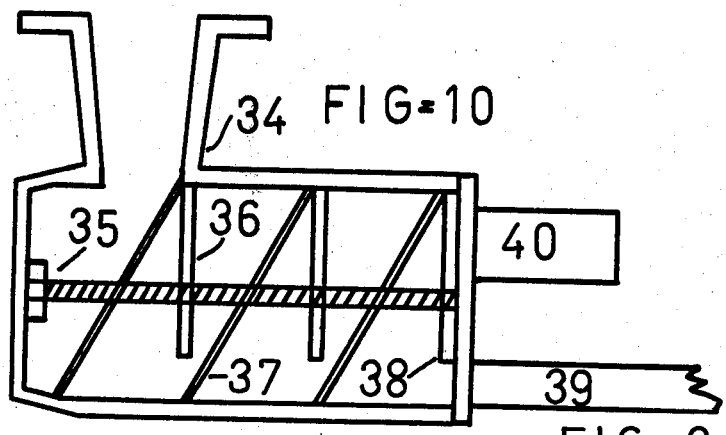
FIG=10
FIG=9
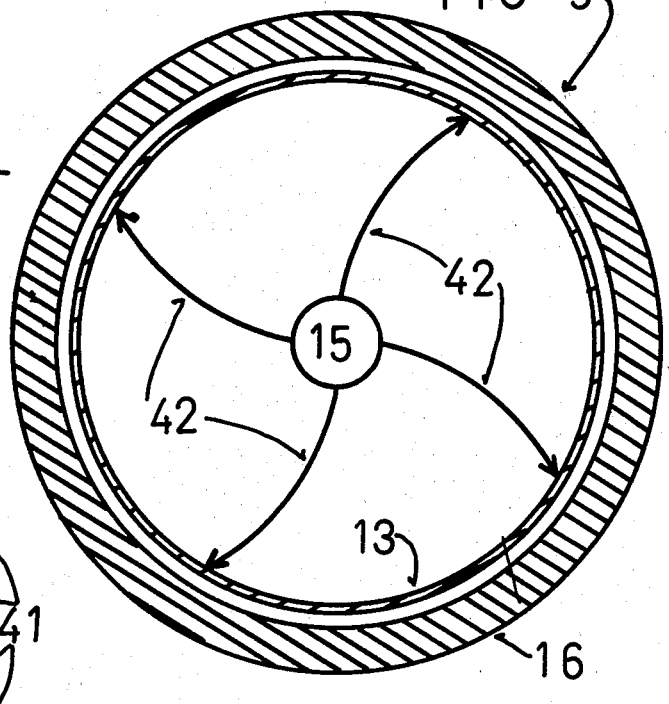
FIG=5
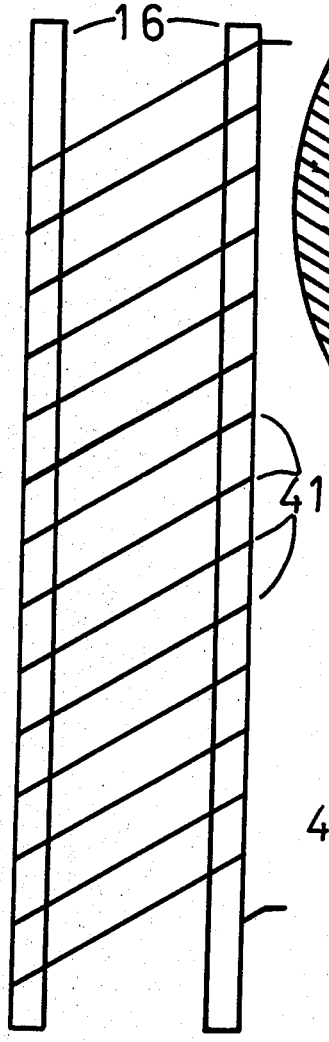
FIG=7
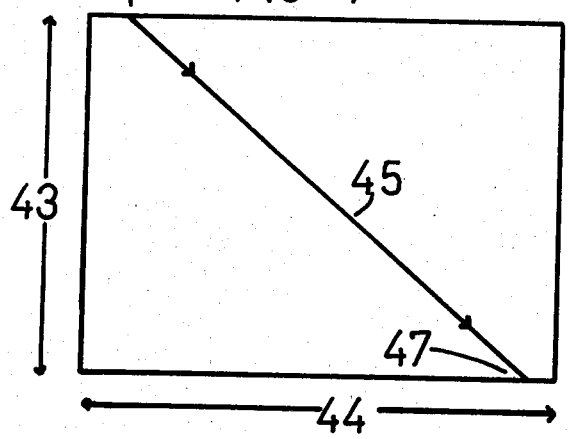

MINE ORE CONCENTRATOR

BACKGROUND OF THE INVENTION

One of the most costly operations in mining is transporting ore from the mine site to the smelter.

In the past various systems to reduce the bulk of the ore by concentrating have been used with varying results.

Systems using various forms of water action, such as scrubbers tend to extract a limited range of particle sizes, and work only on native metals.

These systems also involve massive support to prepare the ore and safely remove the contaminated water used in the process. Much of the same types of problem are associated with chemical treatments related to concentrating.

Magnetic concentrators have been used successfully where the primary metals are ferrous.

A second class of magnetic concentrator uses an eddy current magnetic field that can work on metals, not normally considered magnetic, such as gold, silver and copper.

Eddy current systems in general have a relatively feeble magnetic effect, compared to conventional ferrous systems.

To get a useable amount of magnetic effect, in conventional eddy current systems a large core using a concentrating gap restricts the eddy field to a small area.

This arrangement has several disadvantages in that a large core is limited to a low frequency as the magnetising coil must have many turns of wire, and the core gap causes a hysteresis effect. As eddy current must be generated by a rapidly changing magnetic field, particularly where the nonferrous metal particles are small. Such gap core systems are described in U.S. Pat. Nos. 731,041 and 4,238,323 and are typical of this approach.

In the eddy current system described in this patent several useful and unique principles have been used to solve the shortcoming of previous systems.

As the primary use of this concentrator is to take ore at a mine site and separate out all of the metal components contained in the ore, my concentrator must be able to work on particles of varying shapes and size, that are distributed in the ore.

To do this effectively a limit is set on the maximum size ore particle by screening through a relatively coarse 60 mesh screen. The eddy current field used in this system is distributed between a set of widely spaced cores, so that a particle of general ore must pass between the magnetic field generating cores.

As this field runs the full length of the upper cylinder, a ore particle comes under the influence of this field for several minutes.

As this cylinder is filled with a liquid that limits the rate that a particle can fall through the length of the magnetic field, the eddy current effect accumulates to produce a more pronounced deflection of the metallic particle component of the ore. Metallic particle deflection through this relatively weak, but well distributed field will use far less input power than is possible with a core gap principle.

As metal particle deflection also depends on their physical size, shape, permeability and ohmic resistance, the frequency of the eddy current field starts at a low frequency that will have the greatest effect on the largest ferrous particles, such as iron. This frequency will then increase or sweep to a higher frequency that will have the maximum effect on the smallest nonferrous particle of interest contained in the general ore.

In this way, by setting limits on the high and low frequency range and the time of the sweep duration, metal particles are deflected to varying points on the vertical plain of the upper cylinder. This will be by groups that are characteristic of a particular metal.

These groupings are not purely composed of a single metal, as variables in size and equivalents in permeability or resistance will effect the sorting to some extent, but the groups will be composed of a majority of a given type metal, making secondary refining far simpler.

The shape of the cup core used in this concentrator lends itself to fabrication in ferromagnetic core material that is a low loss core at the range of frequency used in this device. As the losses in the core are small and predictable additional power will be related to the work required to move the range of metal particles.

By comparing this to the various groups of extracted metals on a real time basis a feedback system is established that constantly adjusts the sweep parameters to maintain the established grouping of metals.

The space between the cores where the ore passes is filled with a liquid.

This liquid serves several purposes, however its primary function is to restrict the flow of particles through the cylinder.

This is accomplished by more closely matching the weight of the particles to the weight of the liquid medium they are passing through, thus reducing the differential weight and increasing the viscosity, or resistance to restrict particle travel rate.

The liquid also helps to keep the particles separated as they fall. Where a mine contains metal in solution, chemical converters can be added to the liquid to restore metal particles to a native state. Also, where oily ore or talk tend to cause particles to adhere to each other, suitable solvents can be added to the liquid.

Where extremes in mining temperatures exist, thinners such as antifreeze or thickeners such as glycerin can be added to maintain liquid viscosity under varying temperatures and operating conditions.

As the liquid is continuously recycled, only a small amount of liquid is lost, mainly through evaporation.

This makes getting environmental approval for operating a mine easy.

The liquid also removes variables in the moisture content of the ore by making all of the ore equally wet.

A typical liquid will be %70 water, %10 glycerin, %10 alcohol and %10 specialized chemical treatment.

The liquid also acts as a temperature stabilizer, by acting as a heat sink. This reduces variations in magnetic separability which certain metals are sensitive to.

The eddy current magnetic field is primarily an alternating field moving across a cylinder about eight feet in diameter, and forty feet in length.

By making one side of this field at the outside eight foot diameter of the outer core and the other side of the field at the center of the cylinder, an equal four foot field is generated outward from the center of the cylinder.

This gives the best service as to efficiency, shielding and distribution of the magnetic eddy current.

By offsetting the phase relationship between the center core field and the outside core field, a metal particle is free to move in a spiral path from a point close to the center core to a point at the outside core.

This increases the travel distance and time a particle is under the influence of the field.

The particle cannot move easily through the liquid as the same restricting effect that prevents it from falling quickly through the cylinder equally restricts its movement across the cylinder.

If a particle is given sufficient time, a steady force and inertia will cause the particle to migrate to the wall of the cylinder.

The term particle has so far applied to a piece of native metal of nondefined size and composition.

In the general ore makeup there are also pieces of assorted rock and non metal, which makes up the bulk of the matter passing through the concentrator.

This is generally referred to as steril ore, roughage or tailings. These components are nonmetallic, in that they lack permeability and are not electrically conductive, compaired to metallic elements.

The rapidly changing magnetic field set up by the two cores also passes through these non metals, but their lack of a metallic structure prevents them from being influenced by the eddy field.

These sterile particles fall through the cylinder with the metal particles but are not deflected by the eddy current.

As some sterile particles will by chance fall next to the wall and some will be pushed to the wall of the cylinder by collisions with deflected metal particles, a higher concentration of sterile particles at the wall is expected. However, as metallic components accumulate under the steady force of the magnetic field, they tend to displace the non metal particles back to the center of the cylinder.

In addition to the A.C. field component a D.C. bias field is also generated, and this is used to minimize saturation distortion for the A.C. system and to give a standard magnetic field, so that ferrous components in the metallic makeup of the ore can be quickly deflected and eliminated as they would tend to dissipate eddy current energy needed by the extraction of the nonferrous components. This D.C. system is also useful where cold operating conditions may require some heating to maintain liquid viscosity.

When this device is used in a mine that is primarily iron ore, this D.C. field can remove the bulk of the iron and the eddy current system remove trace metals such as tin and other metals that can in small quantities effect steel quality.

The outside wall of the upper cylinder acts as a stop to metallic components and as they tend to move downward they reach traps or exit points strategically placed along the vertical length of the cylinder.

A third core placed at each exit port helps pull the metallic components into the exit port trap, where they are continuously pumped out as a slurry with some of the liquid.

A settling tank is then used to reclaim the bulk of the liquid for reuse by the concentrator system.

The sterile ore now stripped of its metallic components settles to the bottom of the lower cylinder of the concentrator and is pumped out to a settling tank, in a manner similar to the metal. This device and system are optimized for operation as a mine ore concentrator, where much of the support equipment normally used in mining can be adapted to use with this system.

However its uses in grading scrap metal, removing contaminates from iron and other ores, and its ability to extract trace elements makes its use in general processing highly practical.

BRIEF DESCRIPTION OF THE DRAWINGS

FIG. 1

Figure 11:
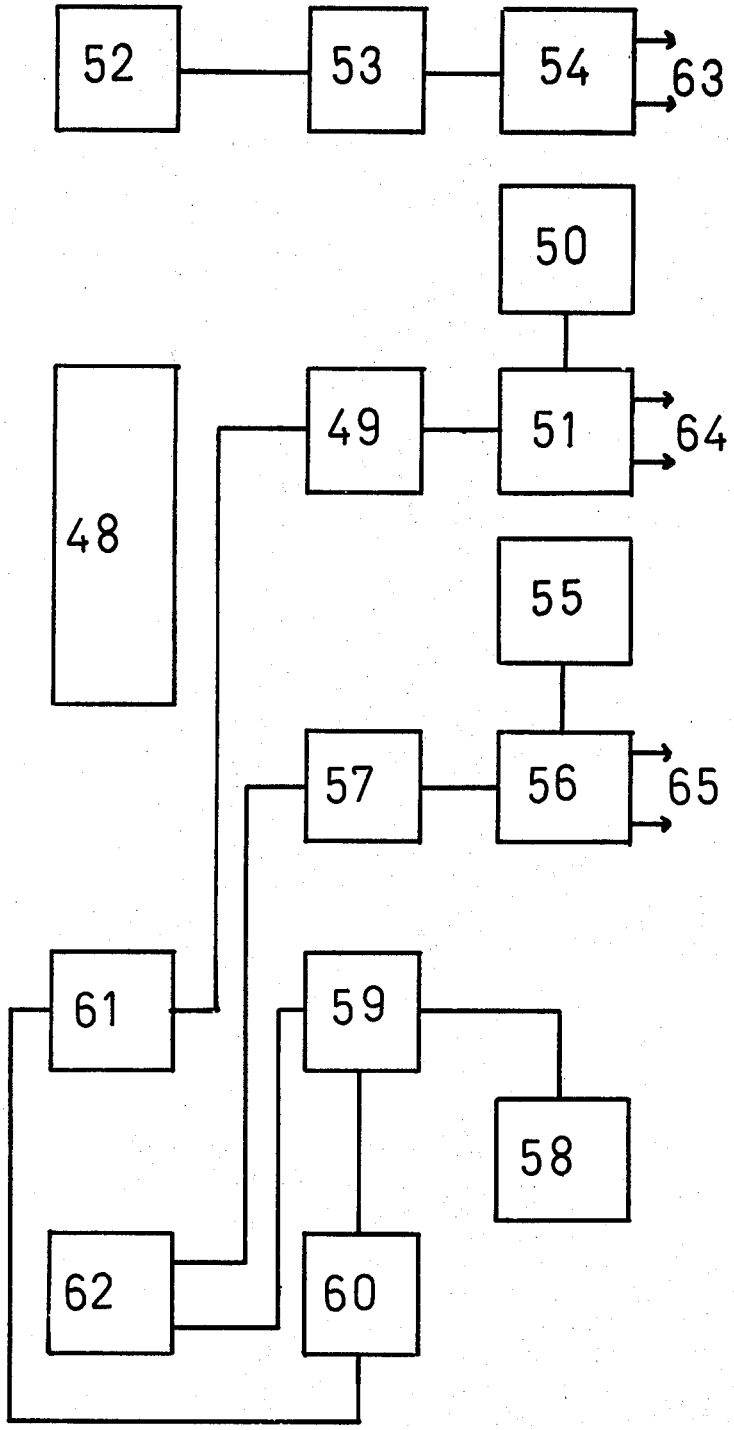

This is a cutaway side view of a single port concentrator with support systems.

FIG. 2

This is a cutaway side view of a multiport concentrator.

FIG. 3

A liquid reclaiming and filtering system.

FIG. 4

This is a side view of the central core and coil.

FIG. 5

This a cutaway view of the outer core and coil.

FIG. 6

A top view of the solenoid core and coil.

FIG. 7

A composite vector diagram of the effect of gravity and time on a metallic component effected by a eddy current.

FIG. 8

This is a top view of the concentrator.

FIG. 9

A top cutaway view of the concentrator showing the passage of the magnetic field and metal particle towards the wall of the cylinder.

FIG. 10

This is a cutaway view of the pump valve as used at the metal and ore extracting ports of the concentrator.

FIG. 11

This is a block diagram of the electronic support system of the concentrator.

DETAILS OF THE DRAWINGS

FIG. 1

This is a cutaway side view of a single port concentrator. (68) is the ore going in to a grinder (66) and carried by a conveyor belt (67) to sifter unit (11). A funnel (12) directs the ground ore into the upper cylinder (14) filled with liquid (13). The ore falls through the liquid (13) enclosed in cylinder (14) towards exit port (18) under the influence of the magnetic field generated between outer core (16) and center core (15). As the deflected metal particles in the general ore approach exit port (18) solenoid core (17) ejects the metal into exit port (18) for removal by pump (19). The remaining sterile ore continues to fall through the lower cylinder (22) and accumulates as represented by sterile ore (20) for removal by pump (21).

FIG. 2

This is a simplified version of FIG. 1, but equipped with additional exit ports, each used to sort or grade a separate type of metal. (18) represents several ports each equipped with a pump (19) and solenoid core (17) identical to the system and description detailed in FIG. 1.

FIG. 3

This is a liquid reclaiming system used in support of the concentrator.

Conveyor belt (23) moves ore or metal from pump (19) or (21) to settling tank (24). The ore or metal components are represented by (25). As pump (26) pumps out the ore or metal to exit port (27), the liquid (28) is returned by return pipe (29) under action of pump (30) to liquid return port (31) for reuse by the concentrator.

FIG. 4

This is a side view of the center core (15) and its coil (32). A protective housing normally covers this assembly, to protect it from abrasion and moisture.

FIG. 5

This is a side view of the outer core (16) and its coil (41). This unit is normally built into the outside wall of the upper cylinder (13) and protected from mechanical abuse.

FIG. 6

This is a top view of solenoid core (17) showing its coil (33). This core is used at each exit port (18).

FIG. 7

This is a vector diagram representing a particle of metal (45) at a starting position (46) at the top of the cylinder, where (43) is passing time and (44) vertical travel through the cylinder to a end position (47) which would be an exit port (18).

FIG. 8

This is a top view of a cylinder (13) showing the relationship of the center core (15) and upper cylinder wall (13) and outer core (16) and solenoid core (17).

FIG. 9

This is a top view of an eddy current field travelling between the center core (15) and the outer core (16). (42) represents a metal particle offset and deflected by the eddy current field.

FIG. 10

This is a side view of the pump valve used to remove metal and ore from the concentrator as represented by (19) and (21). (36) is the pump housing, (35) the central pump shaft, (36) the shaft supports, (37) pump compressing blades, (38) pump gear housing, (39) pump exit shaft, (40) pump drive motor.

FIG. 11

This is a block diagram of the electronic support system of the concentrator. (48) is the power supply. It feeds D.C. power to various electronic systems. (50) introduces a D.C. offset current into the secondary of transformer (51) that drives center core (15) through connection (64). Power driver (49) supplies A.C. drive to voltage amplifier (61) from the basic sweep oscillator (59) that is under control of ramp generator (58). Sweep oscillator (59) also feeds voltage amplifier (62) that feeds power amplifier (57) that drives transformer (56). The secondary of (56) receives a D.C. offset current from (55). The connection at (65) feeds the outside core (16). Oscillator (52) drives amplifier (53) that feeds driver (54). Connection (63) feeds solenoid core (17).

DESCRIPTION OF THE PREFERRED EMBODIMENT

Referring to FIG. 1

Ground ore is sifted through a 60 mesh screen (11). Particles of ore fall gently into the upper cylinder (14) and into the liquid (13).

The particles of general ore then fall slowly towards the lower cylinder (22).

While passing between center core (15) and outer core (16), metal components in the ore come under the influence of the eddy current field moving from the center core (15) to the outer core (16).

This field is constantly pushing the metal particles towards the wall of the upper cylinder (14).

As the metal particles try to get to the outer core (16) the particles also continue to fall.

The eddy current generated across the two cores and through the space the particles must fall is of relatively low power, but runs the length of the upper cylinder.

As the liquid restricts the progress of the falling particles, the eddy current field has several minutes to perform this deflection.

As only metal components of the ore are influenced by this field, the wall of the upper cylinder progressively builds up with metal, that displaces the sterile ore component, towards the center part of the cylinder.

The nature of the eddy current field used in this device is generated by a sine wave oscillator, that is swept over a range of frequencies.

As larger particles of metal are best deflected by a low frequency while, the smaller metal particles respond best to the higher frequency.

In addition to the A.C. eddy current, a D.C. bias current sets up a normal magnetic field. This D.C. field is used to remove ferrous metal quickly from the system, so that the eddy current is reserved for the nonferrous components of the ore.

The sine wave delivered to the center core (15) and the outer core (16) are displaced slightly in phase, so that a particle is deflected in a rotated swirl.

This action is to keep the particle in the influence of the field as long as possible and to prevent particles from being lodged on the wall of the cylinder.

By controlling the frequency, phase and bias of the field, the device can be tailored to any metallic mining situation.

The liquid used in the concentrator serves several functions. The most important is to restrict the passage of the ore particles so that the magnetic field has time to deflect the particles. Secondly, as a conveyor of chemicals to convert certain metals to their metallic form.

As the metal particles near the bottom of the upper cylinder they are deflected into a trap or exit port (18) under the action of a solenoid core (17). The sterile ore restricted to the center of the upper cylinder continues to fall into the lower cylinder (22). This ore (20) is periodically removed by a pump (21).

A similar pump (19) removes the metal from the exit port (18). The concentrator in FIG. 2 is equipped with multiple ore extractor ports, as various metals will be deflected to the wall of the upper cylinder sooner then others depending on their permeability and ohmic resistance.

By placing ports at various points on the upper cylinder a sorting of groups of metals is possible.

Each of these ports will have a separate solenoid core (17) and extracting pump (19), and the outer core (16) will be segmented into several separate cores, each with its own separate coil drivers.

Referring to FIG. 3

The metal ore removed by the pumps will contain some of the liquid from the concentrator by placing it in a settling tank (24). The settled out solid material can be extracted and the liquid returned to the concentrator by port (31).

I claim:

1. An ore or particle concentrator comprising means forming an elongated generally cylindrical separating chamber containing a supply of liquid, a first elongated core centrally fixed in said chamber and charged with high frequency current so as to establish a generally radially, outwardly extending magnetic field in said liquid, a second elongated core of generally annular form positioned radially outwardly of said chamber and also charged with current so as to establish a generally inwardly extending magnetic field, ore or particle supply means positioned above said chamber and adapted to distribute material to be separated across the upper end of said chamber, the fields generated by said first and second cores coacting to move influenced metal components of the material radially outwardly toward the outer wall of the chamber, while relatively uninfluenced material particles continue axially down, and means to separately remove and collect both such components from the separating chamber.

2. Apparatus as in claim 1, and means to charge the cores with alternating current of varying frequency.

3. Apparatus as in claim 1, and means to charge the cores with current having an offset phase relationship so that a rotated magnetic eddy current field is produced in the liquid.

4. Apparatus as in claim 1, and means to generate also a direct current field in said liquid adapted to assist in the removal of ferrous metals.

5. Apparatus as in claim 1, wherein a plurality of axially spaced discharge ports are provided to remove influenced components of the material from different locations along the outer wall of said chamber.

6. Apparatus as in claim 1, and comprising at least one generally annular solenoid core positioned adjacent a component removal means to assist in such removal.

7. Apparatus as in claim 1, and means to separate removed components from the liquid and recycle the liquid back to the separating chamber.

* * * * *